US009083120B2

(12) United States Patent
Chiba et al.

(10) Patent No.: US 9,083,120 B2
(45) Date of Patent: Jul. 14, 2015

(54) SOCKET FOR ELECTRONIC COMPONENTS

(71) Applicant: Alps Electric Co., Ltd., Tokyo (JP)

(72) Inventors: Shigetomo Chiba, Miyagi-ken (JP); Nobuyuki Okuda, Miyagi-ken (JP); Takeki Uozumi, Miyagi-ken (JP); Daisuke Takai, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 189 days.

(21) Appl. No.: 13/860,981

(22) Filed: Apr. 11, 2013

(65) Prior Publication Data

US 2013/0303005 A1 Nov. 14, 2013

(30) Foreign Application Priority Data

May 14, 2012 (JP) ..... 2012-110185
Feb. 7, 2013 (JP) ..... 2013-022160

(51) Int. Cl.

| | |
|---|---|
| ***H01R 13/648*** | (2006.01) |
| ***H01R 13/658*** | (2011.01) |
| ***H01R 13/6596*** | (2011.01) |
| ***H01R 13/6585*** | (2011.01) |

(52) U.S. Cl.

CPC ..... *H01R 13/648* (2013.01); *H01R 13/6585* (2013.01); *H01R 13/6596* (2013.01); *H01R 13/65807* (2013.01)

(58) Field of Classification Search

CPC ..... H01R 13/648; H01R 13/6585; H01R 13/6596; H01R 13/65807

USPC ..... 439/108, 98, 497, 701, 607.05–607.15, 439/541.5, 66

See application file for complete search history.

(56) References Cited

U.S. PATENT DOCUMENTS

| | | | | |
|---|---|---|---|---|
| 3,587,028 | A * | 6/1971 | Uberbacher | 439/49 |
| 4,693,531 | A * | 9/1987 | Raphal et al. | 439/512 |
| 6,247,970 | B1 * | 6/2001 | Ueno et al. | 439/607.05 |
| 6,503,108 | B1 * | 1/2003 | Kikuchi et al. | 439/680 |
| 6,877,223 | B2 | 4/2005 | Figueroa et al. | |

* cited by examiner

*Primary Examiner* — Edwin A. Leon
(74) *Attorney, Agent, or Firm* — Brinks Gilson & Lione

(57) ABSTRACT

A socket for electronic components configured to connect each electrode terminal of an electronic component to a wiring of a wiring board with a shield member having electrical conductivity and multiple openings being disposed on the wiring board, with a contact unit configured to electrically conduct the electrode terminal of the electronic component and the wiring of the wiring board PB being disposed in the openings, and with the contact unit including a ground contacting portion configured to electrically conduct with the shield member, and when the contact unit is for grounding, grounding is performed by the ground contacting portion and the shield member being brought into contact and electrically conducting.

10 Claims, 13 Drawing Sheets

SOCKET FOR ELECTRONIC COMPONENTS

CLAIM OF PRIORITY

This application claims benefit of Japanese Patent Application No. 2012-110185 filed on May 14, 2012 and No. 2013-022160 filed on Feb. 7, 2013, which are hereby incorporated by reference in their entireties.

BACKGROUND

1. Field of the Disclosure

The present disclosure relates to a socket for electronic components, and specifically relates to a socket for electronic components which handles high frequency and enables reduction in size.

2. Description of the Related Art

Nowadays, electronic devices which handle high frequency have increased, and there is demand for sockets for electronic components for high-frequency correspondence. In particular, demand for high-frequency correspondence has been strong for sockets to be used for MPU (Micro Processing Unit). An existing socket for electronic components is disclosed in U.S. Pat. No. 6,877,223.

Hereinafter, a socket for electronic components, disclosed in U.S. Pat. No. 6,877,223, will be described with reference to FIG. 13. FIG. 13 is a diagram illustrating the socket for components SO according to U.S. Pat. No. 6,877,223.

The socket for electronic components SO disclosed in U.S. Pat. No. 6,877,223 has, as illustrated in FIG. 13, a configuration wherein shield plates SB, which are metal plates, are assembled in a lattice shape, and a connection terminal TR, which can electrically conduct with an electrode of an electronic component, is provided within the lattice formed of the shield plates SB.

U.S. Pat. No. 6,877,223 is an example of the related art. The socket for electronic components disclosed in U.S. Pat. No. 6,877,223 includes the shield plates SB to deal with external noise, and has sufficient noise-proof nature for existing applications, but there is concern that sufficient noise-proof nature will not be obtained at the time of handling high frequency.

SUMMARY

A socket for electronic components according to an aspect of the present invention is a socket for an electronic component configured to connect each electrode terminal of the electronic component to a wiring of a wiring board, wherein a shield member having electrical conductivity and including multiple openings is disposed in a housing to be mounted on the wiring board; with a contact unit for signals configured to electrically conduct between an electrode terminal of the electronic component and a wiring of the wiring board, and a contact unit for grounding being disposed in an opening; and with the contact unit for grounding having a ground contacting portion, and in accordance with mounting of the electronic component on the housing, grounding being performed by the ground contacting portion and the shield member electrically conducting.

According to an aspect of the present invention, a ground contacting portion is provided to a contact unit configured to electrically conduct an electrode of an electronic component, and the ground contacting portion is brought into contact with a shield member for grounding, whereby a portion configured to perform electrical conduction and a portion configured to perform grounding may be brought close. The closer the portion configured to perform electrical conduction and the portion configured to perform grounding are, the more the high-frequency property is improved, and accordingly, an advantage is yielded wherein a socket for electronic components which may handle high frequency may be provided.

Within the contact unit, the ground contacting portion is further provided to a moving member closer to a location where electrical conduction is performed, and accordingly, an advantage is yielded wherein the high-frequency property is further improved.

DESCRIPTION OF THE EXEMPLARY EMBODIMENTS

First Embodiment

Hereinafter, a socket for electronic components 100 according to a first embodiment will be described.

Figure 1:
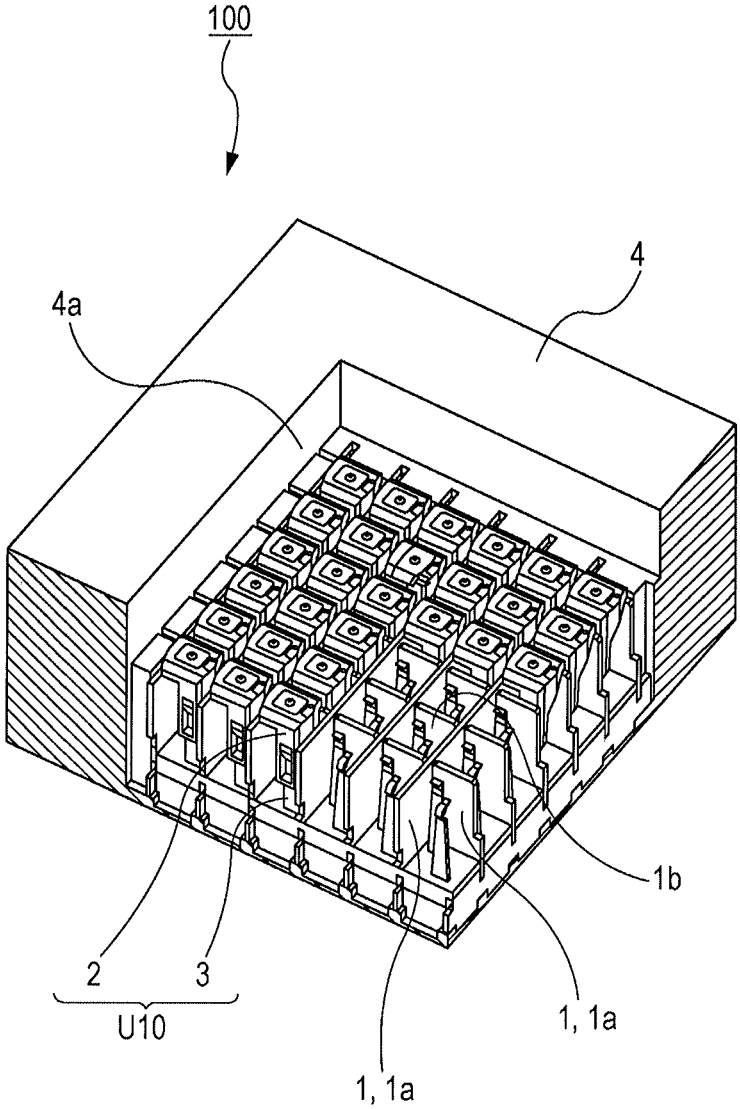
FIG. 1 is a perspective view illustrating a configuration of a socket for electronic components according to a first embodiment.
Figure 2:
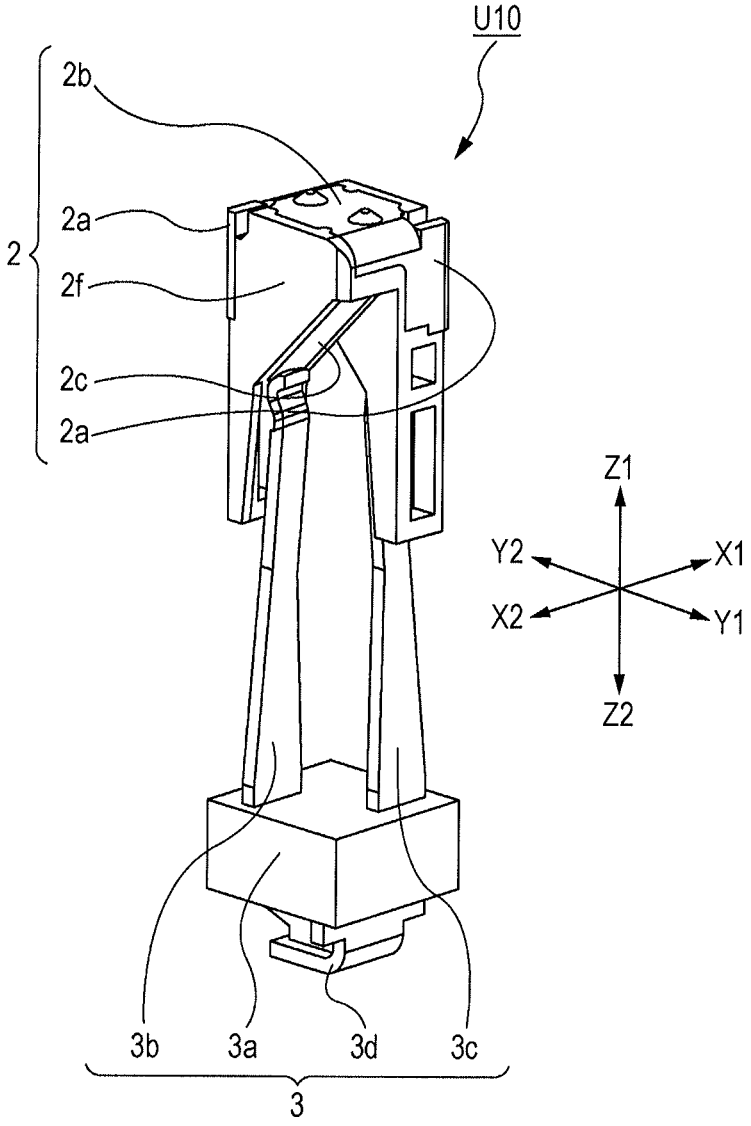
FIG. 2 is a perspective view illustrating a configuration of a contact unit.
Figure 3A:
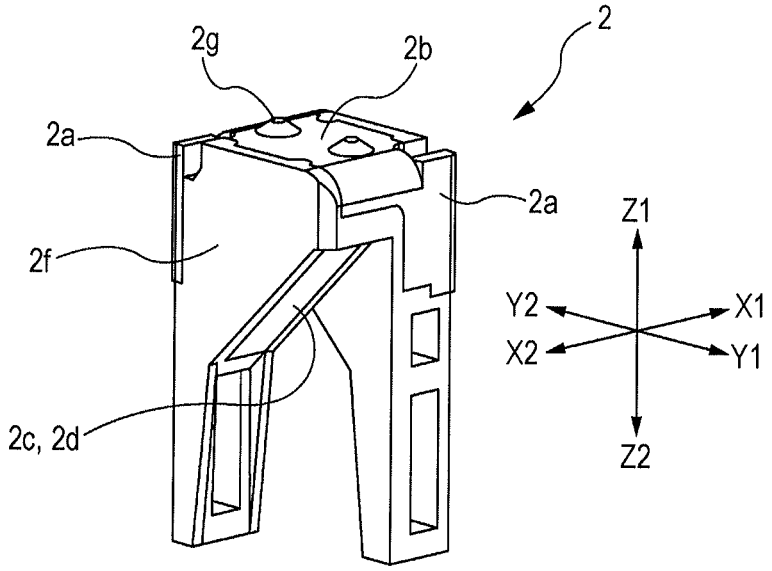
FIGS. 3A and 3B are diagrams illustrating a moving member.
Figure 3B:
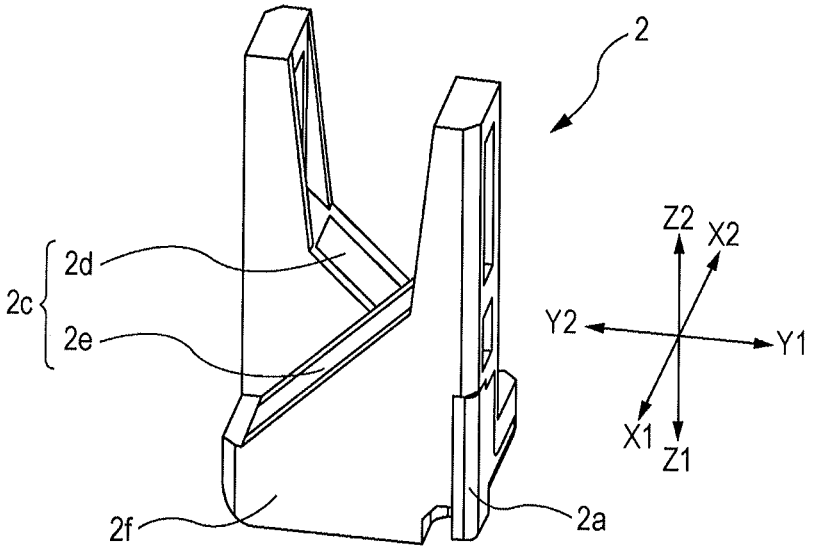
Figure 4:
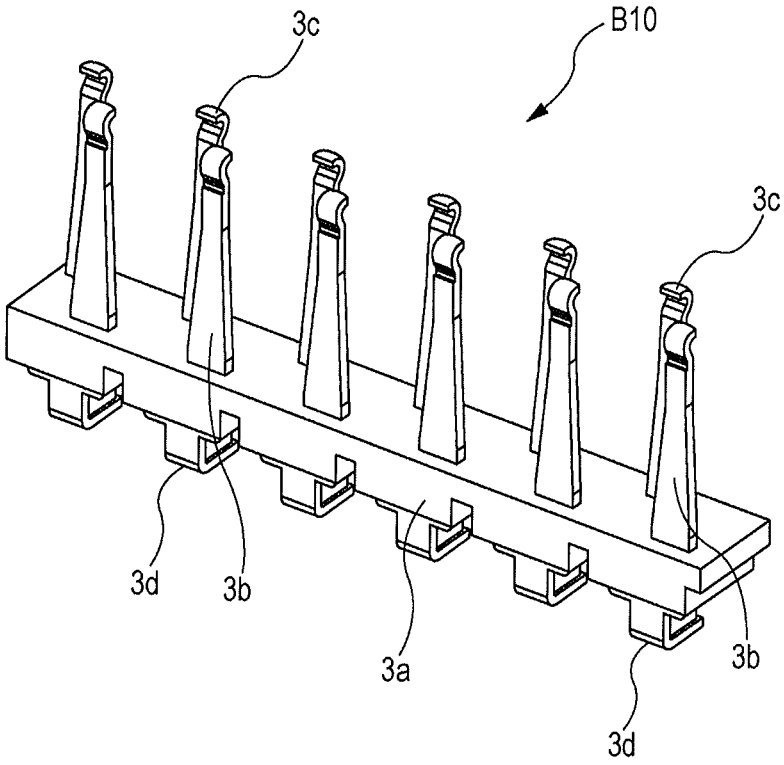
FIG. 4 is a perspective view illustrating a contact bar according to the first embodiment.
Figure 5:
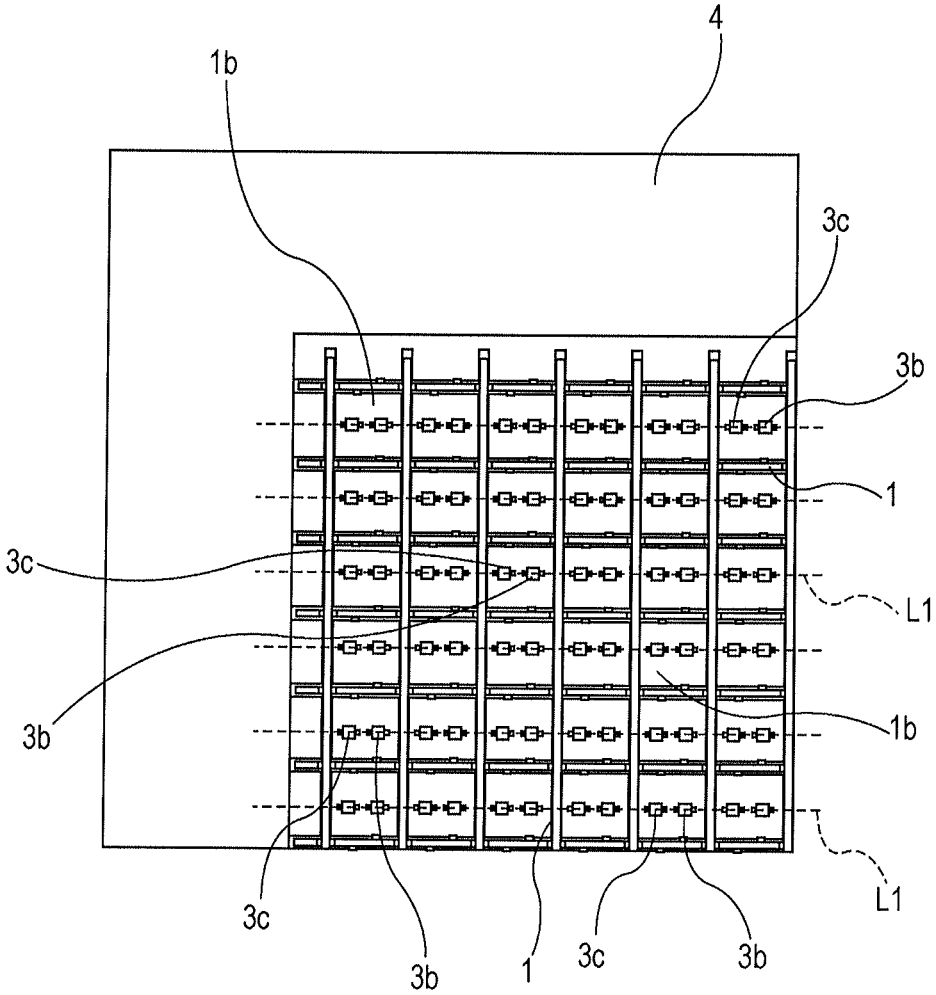
FIG. 5 is a plan view illustrating an allocation example of a first elastic portion and a second elastic portion.
Figure 6:
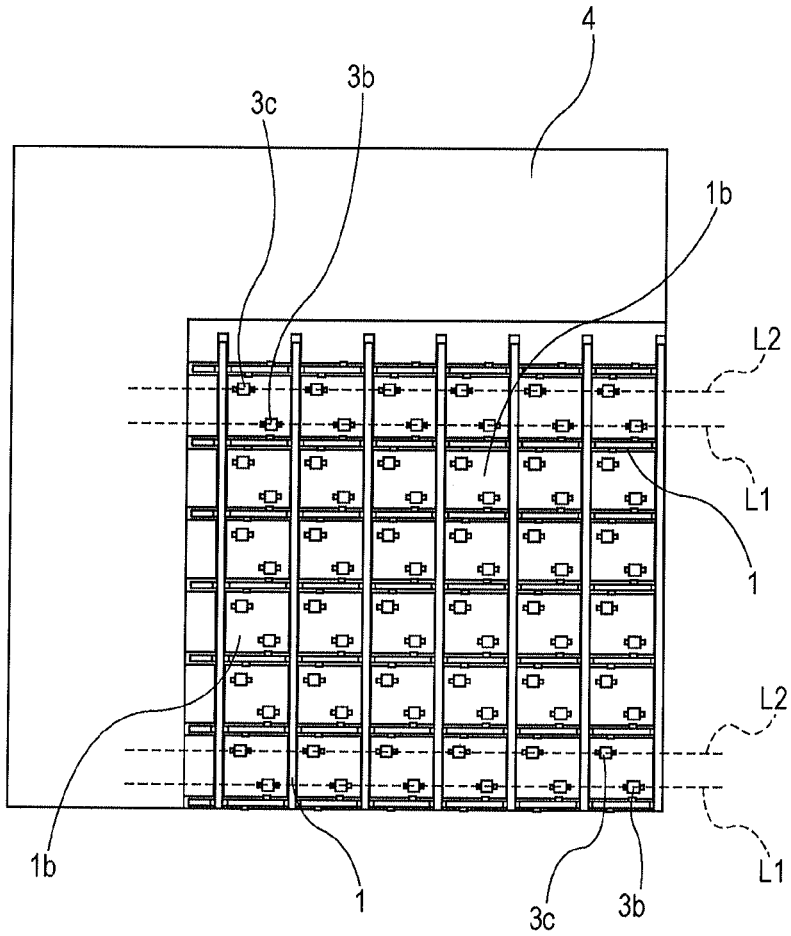
FIG. 6 is a plan view illustrating allocated positions of a first elastic portion and a second elastic portion, according to the first embodiment.

First, description will be made regarding the configuration of the socket for electronic components 100 according to the present embodiment, with reference to FIGS. 1 to 7. FIG. 1 is a perspective view illustrating the configuration of the socket for electronic components 100 according to the first embodiment. Note that, in order to facilitate description, in FIG. 1, a portion of the socket for electronic components 100 is clipped and illustrated, and also a portion of a moving member 2 is not illustrated. FIG. 2 is a perspective view illustrating the configuration of a contact unit U10. FIGS. 3A and 3B are diagrams illustrating the moving member 2, and FIG. 3A is a perspective view illustrating a state in which the moving member 2 is viewed from above, and FIG. 3B is a perspective view illustrating a state in which the moving member 2 is viewed from below. FIG. 4 is a perspective view illustrating a contact bar B10 according to the first embodiment. FIG. 5 is a plan view illustrating allocation of a first elastic portion 3*b* and a second elastic portion 3*c*. FIG. 6 is a plan view illustrating allocated positions of the first elastic portion 3*b* and second elastic portion 3*c* according to the first embodiment. Note that, in FIGS. 5 and 6, in order to facilitate description, the socket for electronic components 100 is partially described, and also the moving member 2 is not illustrated.

The socket for electronic components 100 includes, as illustrated in FIG. 1, a shield member 1 made up of multiple shield plates 1*a*, a contact unit for signals configured to electrically conduct an electrode terminal TM of an electronic component (see FIGS. 7A to 7D), a wiring of a wiring board PB (see FIGS. 7A to 7D), and a contact unit U10 for grounding, and a housing 4 which may hold the shield member 1, the contact unit for signals, and the contact unit U10 for grounding. The contact unit for signals and the contact unit U10 for grounding are alternately disposed, for example. The contact unit U10 is, as illustrated in FIGS. 1 and 2, made up of the moving member 2 and elastic member 3.

The shield member 1 is, as illustrated in FIG. 1, formed by the multiple shield plates 1*a* made up of a metal plate piece being combined in a lattice shape so that the cross section becomes an approximate regular square, and has an opening 1*b* where space is formed within the lattice. Note that the lattice formed by the shield plates 1*a* being combined makes up rows and columns in two directions which intersect perpendicularly.

The moving member 2 is, as illustrated in FIGS. 3A and 3B, made up of a synthetic-resin material and a metal plate, and is formed in a generally rectangular parallelepiped shape. The moving member 2 includes a ground contacting portion 2*a* which may electrically conduct the shield member 1, a contact portion 2*b* having electrical conductivity which may be in contact with an electrode terminal TM of an electronic component, an electroconductive portion 2*c* which electrically conduct the contact portion 2*b*, and a pedestal portion 2*f*. Note that the pedestal portion 2*f* is made up of a synthetic-resin material, and the ground contacting portion 2*a*, contact portion 2*b*, and electroconductive portion 2*c* are made up of one sheet of metal plate, and the ground contacting portion 2*a*, contact portion 2*b*, and electroconductive portion 2*c* mutually electrically conduct. Also, the pedestal portion 2*f* formed in a generally rectangular parallelepiped shape includes the contact portion 2*b* on the upper face (face on Z1 side) with which the electrode terminal TM of the electronic component may come into contact with, includes the ground contacting portion 2*a* on the side faces (face on Y1 side, face on Y2 side), and includes the electroconductive portion 2*c* on the lower face (face on Z2 side).

Also, the electroconductive portion 2*c* includes a first inclined face portion 2*d* where a face inclined one side against the moving direction (Z1-Z2 direction) of the moving member 2, and a second inclined face portion 2*e* where a face inclined the other side against the moving direction (Z1-Z2 direction) of the moving member 2, and with the contact portion 2*b*, two protruding portions 2*g* are formed protruding in the Z1 direction.

The elastic member 3 includes, as illustrated in FIG. 2, a base portion 3*a* made up of a synthetic-resin material and formed in a rectangular parallelepiped shape, a first elastic portion 3*b* and a second elastic portion 3*c* formed in a leaf spring shape made up of a metal plate extending from the upper face (face on Z1 side) of the base portion 3*a* along the moving direction (Z1-Z2 direction) of the moving member 2, and a contacting portion 3*d* which is made up of a metal plate, is formed protruding from the lower face (face on Z2 side) of the base portion 3*a*, and is in contact with a wiring of the wiring board PB. Note that the first elastic portion 3*b*, second elastic portion 3*c*, and contacting portion 3*d* electrically conduct.

Also, with the diagram illustrated in FIG. 2, the contact unit U10 has a configuration wherein one set of the first elastic portion 3*b* and second elastic portion 3*c* are provided to the base portion 3*a*, but with the present embodiment, as illustrated in FIG. 4, this is employed as a mode of the contact bar B10 where multiple sets of the first elastic portion 3*b* and second elastic portion 3*c* are provided to the base portion 3*a*.

Also, the first elastic portion 3*b* and second elastic portion 3*c* may have, as illustrated in FIG. 5, a configuration wherein the root of the first elastic portion 3*b* and the root of the second elastic portion 3*c* are disposed in parallel on the same virtual straight line L1 assumed on the upper face of the base portion 3*a*, but with the present embodiment, as illustrated in FIG. 6, the root of the first elastic portion 3*b* is disposed on the one virtual straight line L2 of two virtual parallel lines assumed on the upper face of the base portion 3*a*, and the root of the second elastic portion 3*c* is disposed on the other virtual straight line L3 of the two virtual parallel lines, and also which are disposed in different positions along the extending direction of the two virtual parallel lines.

The housing 4 is, as illustrated in FIG. 1, made up of a synthetic-resin material, formed in a generally rectangular parallelepiped shape, and includes a storage unit 4*a* where the shield member 1 and contact unit U10 may be disposed.

Next, the configuration of the socket for electronic components 100 will be described with reference to FIGS. 1 and 2. As illustrated in FIG. 1, socket for electronic components 100 has a configuration wherein the contact unit U10 is disposed in the openings 1*b* of the lattice of the shield member 1. At this time, the moving member 2 is, as illustrated in FIG. 2, disposed in a state in which the first inclined face portion 2*d* and first elastic portion 3*b* are in contact on the elastic member 3, and the second inclined face portion 2*e* and second elastic portion 3*c* are in contact. Thus, the elastic member 3 electrically conducts with the wiring of the wiring board PB (see FIGS. 7A to 7D), and also electrically conducts with the conductive portion 2*c* of the moving member 2, and is enabled to electrically conduct to the electrode terminal TM (see FIGS. 7A to 7D) of the electronic component via the contact portion 2*b*. Also, the moving member 2 is disposed so as to move in a pressed direction (Z2 direction) in accordance with coming into contact with the electronic component. Note that, in accordance with the moving member 2 being pressed to move, the ground contacting portion 2*a* provided to the side faces of the moving member 2 may move to a position facing the inner faces of the openings 1*b* of the shield member 1.

Figure 7A:
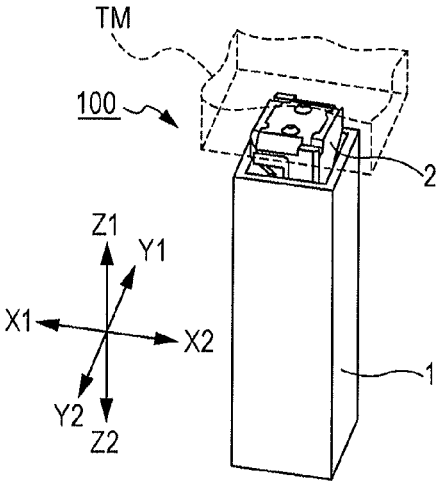
FIGS. 7A to 7D are diagrams for description of operation of the socket for electronic components according to the first embodiment.
Figure 7C:
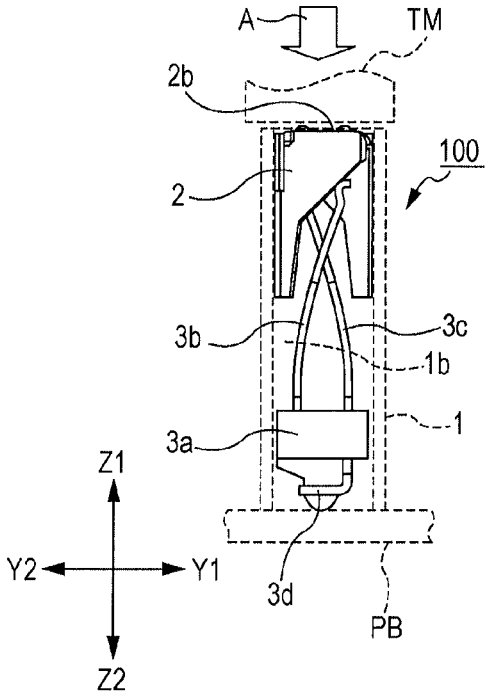
Figure 7B:
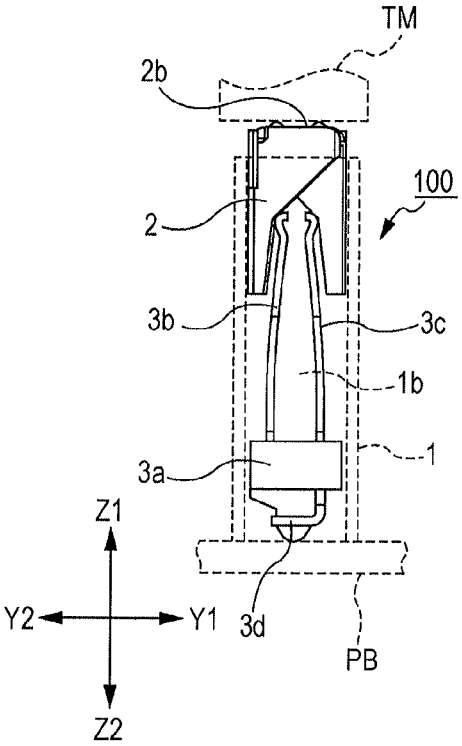
Figure 7D:
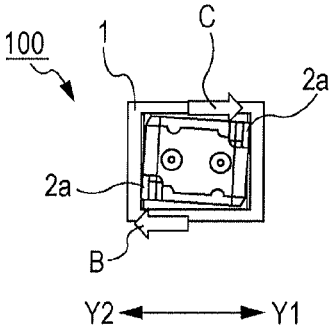

Next, the operation of the socket for electronic components 100 will be described with reference to FIGS. 7A to 7D. FIGS. 7A to 7D are diagrams for description of the operation of the socket for electronic components 100 according to the first embodiment, FIG. 7A is a perspective view illustrating the socket for electronic components 100, FIG. 7B is a side view illustrating the socket for electronic components 100 in the initial state, FIG. 7C is a side view illustrating the socket for electronic components 100 after operation, and FIG. 7D is a top view illustrating the socket for electronic components 100 after operation. Note that, in FIGS. 7A to 7D, in order to facilitate description, the operation in one set of the contact units U10 is illustrated.

Upon an electronic component being attached to the socket for electronic components 100, first, as illustrated in FIG. 7B, the electrode terminal TM of the electronic component and the contact portion 2*b* of the moving member 2 are brought into contact, and between the electronic component and the socket for electronic components 100 electrically conducts. Thereafter, as illustrated in FIG. 7C, upon the moving member 2 being pressed in a direction of an arrow A, the first elastic portion 3*b* is bent along the first inclined face portion 2*d*, and also, the second elastic portion 3*c* is bent along the second inclined face portion 2*e*, and accordingly, the moving member 2 moves to the direction of the arrow A, and electrical conduction between the electronic component and the socket for electronic components 100 is stabilized. At this time, in accordance with movement of the moving member 2, force to press in a direction against movement of the moving member 2 is applied to the first inclined face portion 2*d* and second inclined face portion 2*e* from the first elastic portion 3*b* and second elastic portion 3*c*, respectively. Thus, component of force in the vertical direction is applied to the first inclined face portion 2*d* and second inclined face portion 2*e* in a direction against movement of the moving member 2. This component of force acts in arrow B and arrow C directions illustrated in FIG. 7D, and accordingly, torque acts on the moving member 2, the moving member 2 turns on a virtual axis which is parallel to the moving direction of the moving member 2 as the center, and the ground contacting portion 2*a* and the inner circumference faces of the shield member 1 are brought into contact. Thus, in the event that the contact unit U10 is for grounding, grounding may be performed by the ground contacting portion 2*a* provided to the side face facing the inner faces of the openings 1*b* of the shield member 1 and the inner circumference faces of the shield member 1 electrically conducting. Note that a shield plate 1*a* in a portion corresponding to the contact unit U10 which is not for grounding has been subjected to coating or plating or the like with insulation properties, so even in the event that the ground contacting portion 2*a* of the contact unit U10 not for grounding and the shield member come into contact, grounding does not occur. Also, in the event that the contact unit U10 for grounding is employed, though not illustrated in the drawing, the contacting portion 3*d* and shield member 1 are electrically connected using a method such as connection by a circuit, connection by an electroconductive adhesive agent or solder, or the like.

Note that, upon the electronic component being detached from the socket for electronic components 100, the moving member 2 is returned to the position in the initial state illustrated in FIG. 7B by pressing force of the first elastic portion 3*b* and second elastic portion 3*c*. However, though not illustrated in the drawing, the moving member 2 has been subjected to retaining so as to prevent the moving member 2 from falling off from the shield member 1, and accordingly, a problem is prevented wherein the moving member 2 flies out from the above-mentioned position in the initial state.

Hereinafter, advantages owing to the present embodiment being employed will be described.

The socket for electronic components 100 according to the present embodiment is a socket for electronic components configured to connect each electrode terminal TM of an electronic component and the wiring of the wiring board PB, and has a configuration wherein the shield member 1 where the multiple shield plates 1*a* made up of a metal plate piece are combined in as lattice shape is disposed in the housing 4 which may be mounted on the wiring board PB, the contact unit U10 for electrically conducting between the electrode terminals TM of the electronic component and the wiring board PB is disposed in openings 1*b* of the lattice of the shield member 1, and in the event that the contact unit U10 is for grounding, the contact unit U10 includes the ground contacting portion 2*a*, in accordance with mounting of the electronic component on the housing 4, grounding is performed by the ground contacting portion 2*a* and shield member 1 electrically conducting.

Thus, the ground contacting portion 2*a* is provided to the contact unit U10 configured to perform electrical conduction with the electrode terminals TM of the electronic component, and grounding is performed by bringing the ground contacting portion 2*a* into contact with the shield member 1 to electrically conduct both, and accordingly, a portion configured to perform electrical conduction, and a portion configured to perform grounding may be brought close. The closer the portion to perform electrical conduction and the portion to perform grounding are, the more the high-frequency property is improved, and accordingly, an advantage is yielded wherein a socket for electronic components capable of handling high frequency may be provided.

Also, the socket for electronic components 100 according to the present embodiment is configured wherein the contact unit U10 includes the moving member 2 and elastic member 3, the moving member 2 has electrical conductivity and includes the contact portion 2*b* which is in contact with the electrode terminal TM of the electronic component, and the electroconductive portion 2*c* which electrically conducts with the contact portion 2*b*, and also enables to move in accordance with coming into contact with an electronic component, the elastic member 3 electrically conduct the wiring of the wiring board, and also electrically conduct the electroconductive portion 2*c* of the moving member 2, and presses the moving member 2 in a direction against movement of the moving member 2.

Thus, even within the contact unit U10, the ground contacting portion 2*a* is further provided to the moving member 2 close to a portion configured to perform electrical conduction, an advantage is yielded wherein the high-frequency property is further improved.

Also, with the socket for electronic components 100 according to the present embodiment, in the event that the contact unit U10 is for grounding, the moving member 2 is configured to include the ground contacting portion 2*a* on a side face facing the inner faces of the openings 1*b* of the shield member 1.

Thus, the moving member 2 is configured to include the ground contacting portion 2*a* on the side face facing the inner faces of the openings 1*b* of the shield member 1, and accordingly, an advantage is yielded wherein the openings 1*b* and ground contacting portion 2*a* are readily brought into contact, and grounding is performed in a more sure manner.

Also, the socket for electronic components 100 according to the present embodiment is configured wherein the elastic member 3 includes a base portion 3*a* which may be disposed in the housing 4, and the first elastic portion 3*b* and second elastic portion 3*c* formed in a leaf spring shape extending along the moving direction of the moving member 2 from the based portion 3*a*, and in the event that the contact unit U10 is for grounding, the moving member 2 includes the contact portion 2*b* on the upper face with which the electrode terminals TM of the electronic component may be brought into contact, includes the ground contacting portion 2*a* on the side face, and includes the electroconductive portion 2*c* on the lower face, and the contact portion 2*b*, electroconductive portion 2*c*, and ground contacting portion 2*a* mutually electrically conduct, the electroconductive portion 2*c* includes the first inclined face portion 2*d* where a face inclined in one side against the moving direction of the moving member 2 is formed, and the second inclined face portion 2*e* where a face inclined in the other side against the moving direction of the moving member 2 is formed, and the moving member 2 is disposed on the elastic member 3 in a state in which the first inclined face portion 2*d* and first elastic portion 3*b* are brought into contact, and the second inclined face portion 2*e* and second elastic portion 3*c* are brought into contact, and in accordance with movement of the moving member 2, the moving member 2 turns on an axis parallel to the moving direction of the moving member 2 as the center by elastic force of the elastic member 3, and the ground contacting portion 2*a* and shield member 1 electrically conduct, and grounding is performed.

Thus, upon the moving member 2 being pressed in the moving direction, the first elastic portion 3*b* is bent while slidably contacting the first inclined face portion 2*d*, and similarly, the second elastic portion 3*c* is bent along the second inclined face portion 2*e*. According to the pressing force of the first elastic portion 3*b* and the pressing force of the second elastic portion 3*c*, the first inclined face portion 2*d* and second inclined face portion 2*e* are pressed in the facing direction, and accordingly, torque acts on the moving member 2, and the moving member 2 turns on a virtual axis parallel to the moving direction as the center. Accordingly, in the event that the moving member 2 is employed as the contact unit U10 for grounding, the ground contacting portion 2*a* is pressed against and brought into contact with the shield member 1 by the moving member 2 turning within the lattice of the shield member 1, and accordingly, the moving member 2 and shield member 1 electrically conduct, and an advantage is yielded wherein a socket for electronic components which performs stable grounding and enables to handle high frequency may be provided.

Also, the socket for electronic components 100 according to the present embodiment is configured wherein the root of the first elastic portion 3*b* is disposed on one virtual straight line L2 of two virtual parallel lines assumed on the upper face of the base portion 3*a*, the root of the second elastic portion 3*c* is disposed on the other virtual straight line L3 of the two virtual parallel lines, and also, the first elastic portion 3*b* and second elastic portion 3*c* are disposed in different positions along the extending directions of the two virtual parallel lines.

Thus, the root of the first elastic portion 3*b* is disposed on one L2 of the two virtual parallel lines assumed on the upper face of the base portion 3*a*, and the root of the second elastic portion 3*c* is disposed on the other L3 of the two parallel straight lines, and accordingly, the moving member 2 may readily turn by applying torque to the moving member 2 using the pressing force of the first elastic portion 3*b* and the pressing force of the second elastic portion 3*c*. Thus, the ground contacting portion 2*a* may be brought into contact with the shield member 1 in a sure manner, and accordingly, an advantage is yielded wherein a socket for electronic components which performs further stable grounding on high frequency may be provided.

Also, with the socket for electronic components 100 according to the present embodiment, the shield member 1 is configured of multiple shield plates 1*a* made up of a metal plate piece being combined in a lattice shape.

Thus, the shield member 1 is configured of multiple shield plates 1*a* made up of a metal plate piece being combined in a lattice shape, and accordingly, an advantage is yielded wherein the multiple openings 1*b* having electrical conductivity may readily be formed.

Also, with the socket for electronic components 100 according to the present embodiment, the elastic member 3 is configured to be employed as a mode of the contact bar B10 where multiple sets of the first elastic portion 3*b* and second elastic portion 3*c* are provided to the base portion 3*a*.

Thus, the multiple elastic members 3 are collectively taken as the contact bar B10, and accordingly, advantages are yielded wherein product assembly is facilitated, and also, as compared to a case where the elastic member 3 where one set of the first elastic portion 3*b* and second elastic portion 3*c* are disposed is individually disposed on the base portion 3*a*, deformation or the like of the first elastic portion 3*b* and second elastic portion 3*c* hardly occurs, and a socket for electronic components with electrical conduction being stabilized may be provided.

Also, with the socket for electronic components 100 according to the present embodiment, in the event that the contact unit U10 is employed for grounding, the elastic member 3 is configured wherein the shield member 1 is ground-connected on a side closer to the wiring board PB than the ground contacting portion 2*a* of the moving member 2, that is, the contacting portion 3*d* and shield member 1 are electrically connected by a method such as connection by a circuit, or connection by an electroconductive adhesive agent or solder, or the like.

Thus, the contact unit U10 is grounded with two portions of the upper portion of the shield member 1 and the lower portion of the shield member 1. In the event that grounding is performed with any one of the upper portion of the shield member 1 and the lower portion of the shield member 1, and the contact unit U10, between the contact portion 2*b* and contacting portion 3*d* may be regarded as circuits connected in series. Also, in the event that grounding is performed with the two portions of the upper portion and lower portion of the shield member 1, between the contact portion 2*b* and contacting portion 3*d* may be regarded as circuits connected in parallel. When comparing resistance between the contact portion 2*b* and contacting portion 3*d* in the event that grounding is performed with the two portions of the upper portion and lower portion of the shield member 1 and in the event that grounding is performed with the contact portion 2*b* and the two portions of the upper portion and lower portion of the shield member 1, resistance decreases in the event that grounding is performed with the two portions of the upper portion and lower portion of the shield member 1. Accordingly, grounding is performed with the two portions of the upper portion and lower portion of the shield member 1, and accordingly, an advantage is yielded wherein noise is hardly picked up, and high frequency is readily handled.

Second Embodiment

Hereinafter, a socket for electronic components 200 according to a second embodiment will be described with reference to FIGS. 8 and 9. FIGS. 8A to 8C are perspective views illustrating the configuration of the socket for electronic components 200 according to the second embodiment. Note that in FIGS. 8A to 8C, in order to facilitate description, only one set of contact units U20 and shield member 1 covering surroundings thereof are illustrated. FIGS. 9A and 9B are perspective views illustrating a moving member 5 according to the second embodiment, FIG. 9A is a perspective view illustrating a state in which the moving member 5 according to the second embodiment is viewed from above, and FIG. 9B is a perspective view illustrating a state in which the moving member 5 according to the second embodiment is viewed from below. The socket for electronic components 200 according to the present embodiment differs in the shape of the moving member 2 of the socket for electronic components 100 according to the first embodiment.

In the following description, with regard to the common components as with the socket for electronic components 100 according to the first embodiment, detailed description will be omitted, and also, with regard to component names and component reference numerals, description will be made using the same as with the socket for electronic components 100.

Figure 8A:
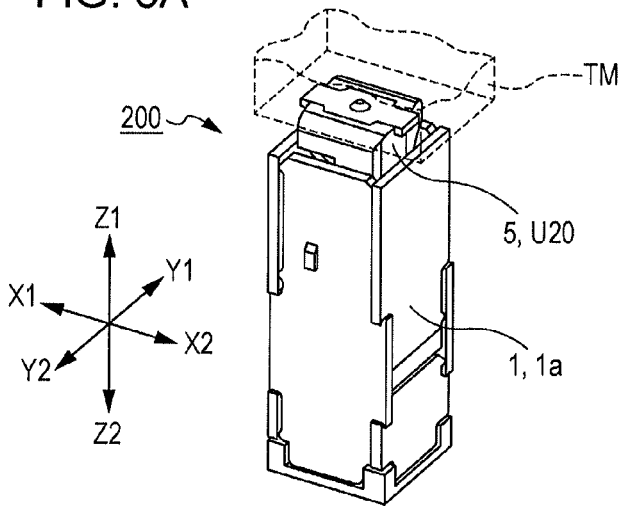
FIGS. 8A to 8C are perspective views illustrating a configuration of a socket for electronic components according to a second embodiment.
Figure 9A:
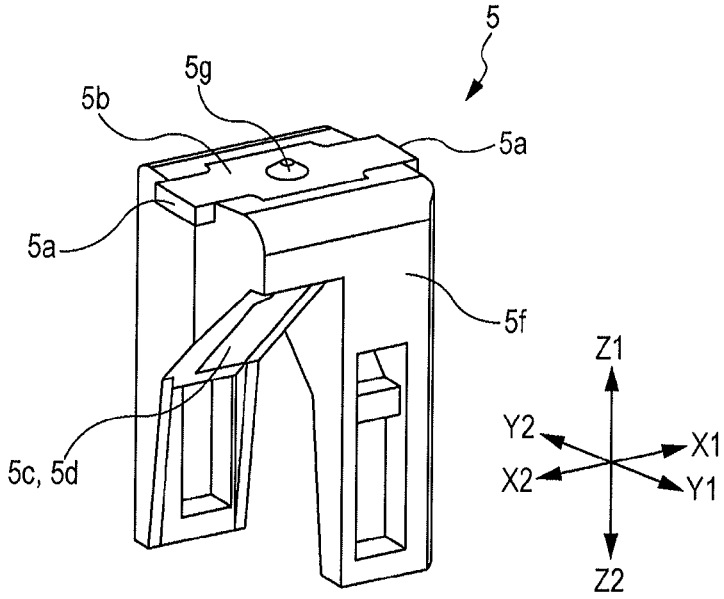
FIGS. 9A and 9B are perspective views illustrating a moving member according to the second embodiment.
Figure 9B:
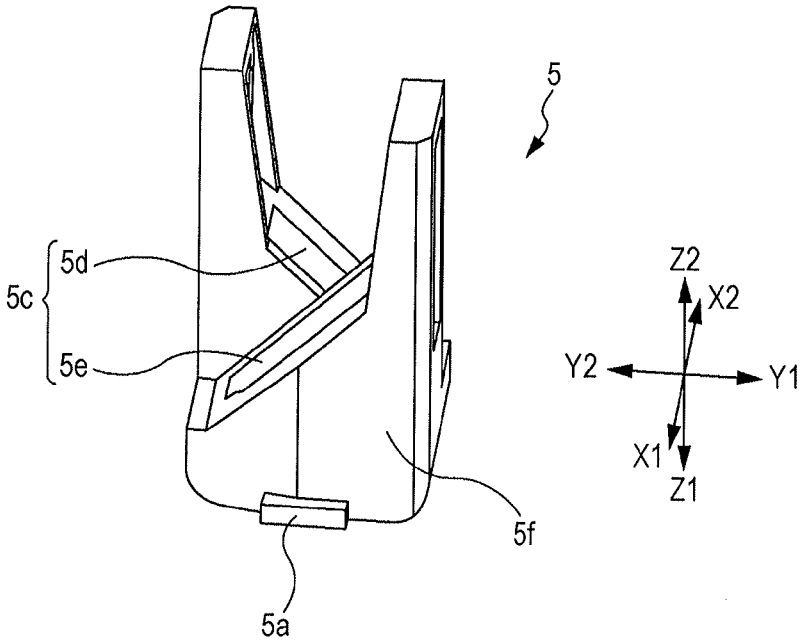

The socket for electronic components 200 includes, as illustrated in FIG. 8A, the shield member 1, contact unit U20, and housing 4 (see FIG. 1). The contact unit U20 is made up of the moving member 5 and elastic member 3 (see FIG. 2).

The shield member 1, elastic member 3, and housing 4 are common to the socket for electronic components 100 according to the first embodiment, and accordingly, detailed description will be omitted.

The moving member 5 is, as illustrated in FIGS. 9A and 9B, made up of a synthetic-resin material and a metal plate, and formed in a generally rectangular parallelepiped shape. The moving member 5 includes a ground contacting portion 5*a* which may electrically conduct the shield member 1, a contact portion 5*b* having electrical conductivity which may come into contact with the electrode terminal TM of an electronic component, an electroconductive portion 5*c* which electrically conducts the contact portion 5*b*, and a pedestal portion 5*f*. Note that the pedestal portion 5*f* is made up of a synthetic-resin material, the ground contacting portion 5*a* and contact portion 5*b* and electroconductive portion 5*c* are formed of one metal plate, and the ground contacting portion 5*a*, contact portion 5*b*, and electroconductive portion 5*c* mutually electrically conduct. Also, the pedestal portion 5*f* formed in a generally rectangular parallelepiped shape includes the contact portion 5*b* on the upper face (face on Z1 side), includes the ground contacting portion 5*a* formed protruding in two directions which laterally face to each other from the upper face, and includes the electroconductive portion 5*c* on the lower face (face on Z2 side). Note that distance dimension between the tips of the ground contacting portion 5*a* formed protruding in the two directions which face to each other is longer than the interval dimension of the shield plates 1*a*.

Also, the electroconductive portion 5*c* includes a first inclined face portion 5*d* where a face inclined in one side against the moving direction (Z1-Z2 direction) of the moving member 5 is formed, and a second inclined face portion 5*e* where a face inclined in the other side against the moving direction (Z1-Z2 direction) of the moving member 5 is formed, and a protruding portion 5*g* formed protruding in the Z1 direction is formed on the contact portion 5*b*.

Next, the configuration of the socket for electronic components 200 will be described with reference to FIGS. 8A to 8C. The socket for electronic components 200 has, as illustrated in FIGS. 8A to 8C, a configuration wherein the contact unit U20 is disposed in the openings 1*b* of the lattice of the shield member 1. At this time, the moving member 5 is disposed on the elastic member 3 in a state in which the first inclined face portion 5*d* is in contact with the first elastic portion 3*b*, and also, the second inclined face portion 5*e* is in contact with the second elastic portion 3*c*. Thus, the elastic member 3 electrically conducts with the wiring of the wiring board PB, and also electrically conducts with the electroconductive portion 5*c* of the moving member 5, and enables electrically conducting with the electrode terminal TM of the electronic component, via the contact portion 5*b*. Also, the moving member 5 is, in accordance with coming into contact with the electronic component, disposed so as to move in the pressed direction.

Next, the operation of the socket for electronic components 200 will be described with reference to FIGS. 8A to 8C.

Figure 8B:
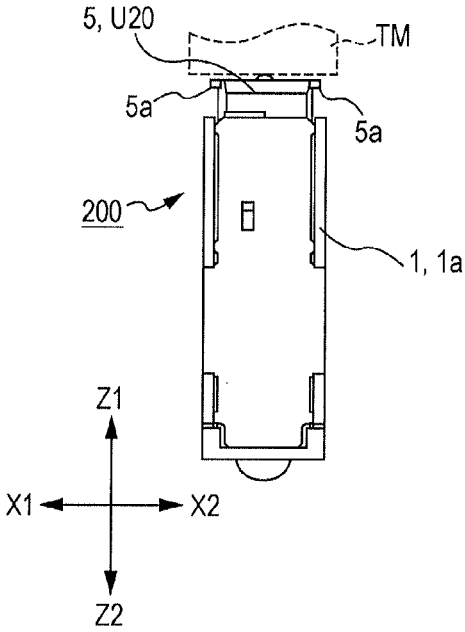
Figure 8C:
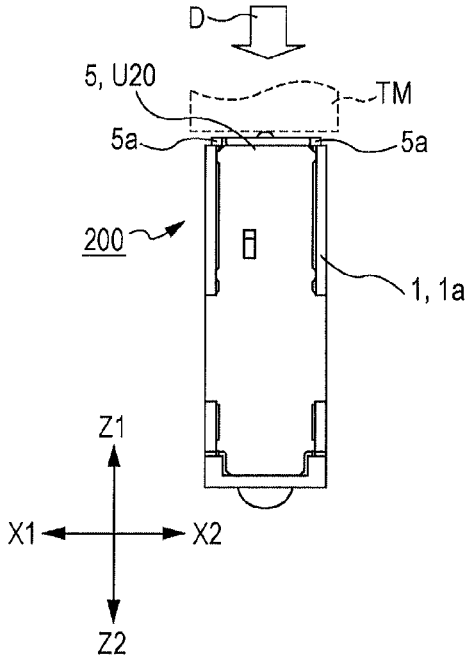

Upon an electronic component being attached to the socket for electronic components 200, first, as illustrated in FIG. 8B, the electrode terminal TM of the electronic component comes into contact with the contact portion 5*b* of the moving member 5, and between the electronic component and the socket for electronic components 200 electrically conduct. Thereafter, as illustrated in FIG. 8C, upon the moving member 5 being pressed in a direction of an arrow D, in the same way as with socket for electronic components 100 according to the first embodiment, the first elastic portion 3*b* (see FIG. 7C) is bent along the first inclined face portion 5*d* (see FIG. 8B), and also, the second elastic portion 3*c* (see FIG. 7C) is bent along the second inclined face portion 5*e* (see FIG. 8B), and accordingly, the moving member 5 moves to the direction of the arrow D, and electrical conduction between the electronic component and the socket for electronic components 200 is stabilized. The moving member 5 moves in the direction of the arrow D, and accordingly, the ground contacting portion 5*a* comes close to the upper edge portion of the shield member 1. Distance dimension between the tips of the ground contacting portion 5*a* formed protruding in the directions which face to each other is longer than interval dimension between the shield plates 1*a*, and accordingly, the ground contacting portion 5*a* comes into contact with the upper edge portion of the shield member 1. Thus, in the event that the contact unit U20 is for grounding, the ground contacting portion 5*a* and the upper edge portion of the shield member 1 electrically conduct, and grounding is performed. The shield plate 1*a* in a portion corresponding to the contact unit U20 which is not for grounding has been subjected to coating or plating with insulation properties, and even when the ground contacting portion 5*a* of the contact unit U20 which is not for grounding comes into contact with the shield member 1, grounding is not performed. Also, in the event that the contact unit U20 is employed for grounding, though not illustrated in the drawing, the contacting portion 3*d* (see FIG. 7B) and shield member 1 are electrically connected by a method such as connection by a circuit, or connection by an electroconductive adhesive agent or solder, or the like.

Note that, upon the electronic component being detached from the socket for electronic components 200, the moving member 5 is returned to the position in the initial state illustrated in FIG. 8B by the pressing force of the first elastic portion 3*b* and second elastic portion 3*c*.

Hereinafter, advantages owing to the present invention being employed will be described.

The socket for electronic components 200 according to the present embodiment is configured wherein the moving member 5 is formed in a rectangular parallelepiped shape, includes the contact portion 5*b* on the upper face, and includes at least the ground contacting portion 5*a* formed externally protruding in the side faces, and includes the electroconductive portion 5*c* on the lower face, the contact portion 5*b*, electroconductive portion 5*c*, and grounding contacting portion 5*a* mutually electrically conduct, distance dimension between the tips of the ground contacting portion 5*a* is longer than interval dimension between the shield plates 1*a*, and in the event that the contact unit U10 is for grounding, in accordance with movement of the moving member 5, the ground contacting portion 5*a* and the upper edge portion of the shield member 1 are brought into contact, and electrically conduct, thereby performing grounding.

Thus, the ground contacting portion 5*a* formed externally protruding from the side faces of the moving member 5 comes into contact with the upper edge portion of the shield member 1, and grounding is performed, and accordingly, an advantage is yielded wherein a portion to perform electrical conduction and a portion to perform grounding may further be brought close, and the high-frequency property may further be improved.

Also, thus, the grounding contacting portion 5*a* and the upper edge portion of the shield member 1 are brought into contact, and accordingly, the moving member 5 is prevented from being unnecessarily pressed into the lattice of the shield member 1. Accordingly, it may be prevented that the elastic member 3 is deformed by unreasonable pressing, and is not returned to the initial position, and results in electroconductive failure.

Third Embodiment

Figure 10A:
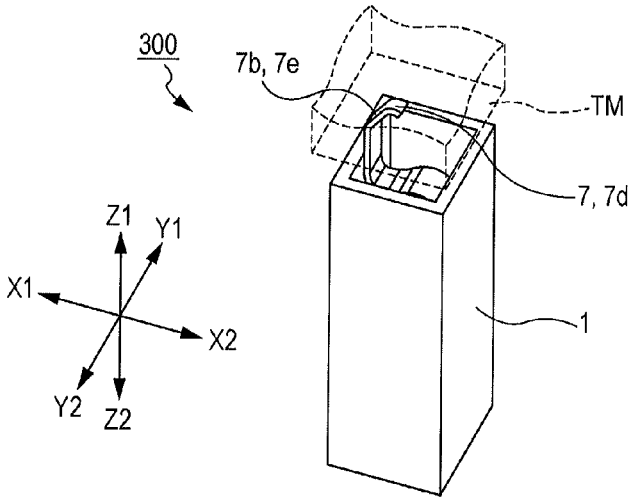
FIGS. 10A to 10C are diagrams illustrating a configuration of a socket for electronic components according to a third embodiment.
Figure 10B:
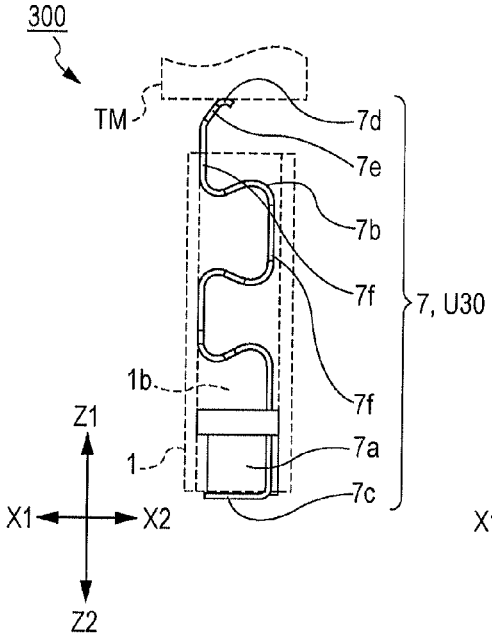
Figure 10C:
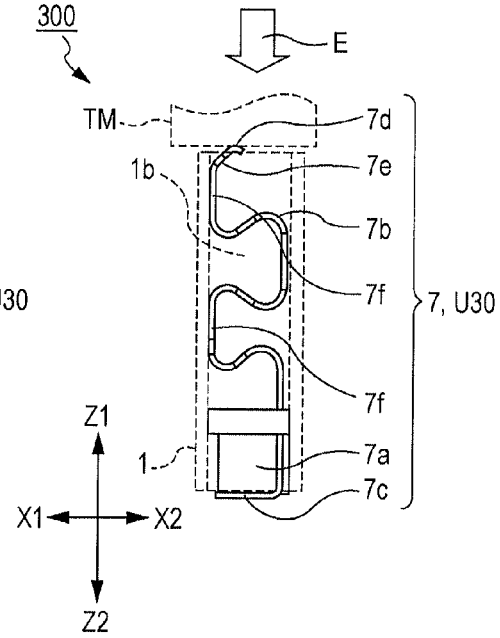

Hereinafter, a socket for electronic components 300 according to a third embodiment will be described with reference to FIGS. 10A to 10C. The socket for electronic components 300 according to the present embodiment differs in the configurations of the contact unit U10 according to the first embodiment and the contact unit U20 according to the second embodiment. In the following description, with regard to components common to the socket for electronic components 100 according the first embodiment and socket for electronic components 200 according the second embodiment, detailed description will be omitted, and also, description will be made using the same component names and component reference numerals as with the socket for electronic components 100 and the socket for electronic components 200. FIGS. 10A to 10C are diagrams illustrating the configuration of the socket for electronic components 300 according to the third embodiment, FIG. 10A is a perspective view illustrating the appearance of a contact unit U30, FIG. 10B is a side view illustrating the initial state of the contact unit U30, and FIG. 10C is a side view illustrating the operation state of the contact unit U30. Note that, in FIGS. 10A to 10C, in order to facilitate description, the housing 4 is not illustrated, and only the shield member 1 and contact unit U30 are illustrated.

The socket for electronic components 300 includes, as illustrated in FIGS. 10A to 10C, the shield member 1, contact unit U30, and housing 4 (see FIG. 1).

The shield member 1 and housing 4 are common to the socket for electronic components 100 according to the first embodiment and socket for electronic components 200 according to the second embodiment, and accordingly, detailed description will be omitted.

The contact unit U30 includes, as illustrated in FIGS. 10A to 10C, a base portion 7*a* made up of a synthetic-resin material and formed in a rectangular parallelepiped shape, an elastic portion 7*b* made up of a metal plate and formed in a leaf spring shape extending from the upper face (Z1 side face) of the base portion 7*a* to a direction perpendicular to the upper face (Z1-Z2 direction) so as to meander with a predetermined width dimension and a predetermined pitch, and a contacting portion 7*c* made up of a metal plate and formed along the lower face (Z2 side face) of the base portion 7*a* which is in contact with the wiring of the wiring board PB. In the vicinity of the tip of the elastic portion 7*b*, a contact portion 7*d* which has electroconductivity and is in contact with the electrode terminal TM of an electronic component, and an electroconductive portion 7*e* which electrically conducts the contact portion 7*d* are formed. Also, with the present embodiment, multiple portions generally in parallel with a direction perpendicular to the upper face of the base portion 7*a* (Z1-Z2 direction) are formed in the elastic portion 7*b*. The portions generally in parallel with a direction perpendicular to the upper face of the base portion 7*a* (Z1-Z2 direction) are formed in a portion where the elastic portion 7*b* meanders with a predetermined width dimension, and serve as ground contacting portions 7*f*.

Also, with the diagrams illustrated in FIGS. 10A to 10C, the contact unit U30 has a configuration wherein one elastic portion 7*b* is provided to the base portion 7*a*, but with the present embodiment, as with the first embodiment, the multiple elastic portions 7*b* may be employed with the mode of a contact bar (not illustrated) provided to the base portion 7*a*.

Next, the configuration of the socket for electronic components 300 will be described with reference to FIG. 10B. The socket for electronic components 300 has, as illustrated in FIG. 10B, a configuration wherein the contact unit U30 is disposed in the openings 1*b* of the lattice of the shield member 1. The elastic member 7 electrically conducts the wiring of the wiring board PB, and accordingly, electrical conduction with the electrode terminal TM of the electronic component may be performed via the contact portion 7*d* (elastic portion 7*b*). Also, the contact portion 7*d* (elastic portion 7*b*) is disposed so as to move by being bent in the pressed direction, in accordance with coming into contact with the electronic component.

Also, in the event that the contact unit U30 is for grounding, grounding may be performed by the ground contacting portions 7*f* and the shield member 1 being brought into contact. Note that the shield plate 1*a* in a portion corresponding to the contact unit U30 which is not for grounding has been subjected to coating or plating with insulation properties, and grounding is not performed even when the ground contact portions 7*f* of the contact unit U30 which is not for grounding and the shield member 1 are brought into contact.

Next, the operation of the socket for electronic components 300 will be described with reference to FIGS. 10B and 100.

Upon an electronic component being attached to the socket for electronic components 300, first, as illustrated in FIG. 10B, the electrode terminal TM of the electronic component and the contact portion 7*d* are brought into contact, and the electronic component and the electronic components 300 are electrically connected. Thereafter, as illustrated in FIG. 100, upon the contact portion 7*d* being pressed in a direction of an arrow E, the elastic portion 7*b* is bent, the contact portion 7*d* is extended in a direction orthogonal to the direction where the contact portion 7*d* is pressed (X1-X2 direction), and the ground contact portions 7*f* and the inner face of the shield member 1 are brought into contact. In the event that the contact unit U30 is for grounding, grounding may be performed by the ground contacting portions 7*f* and the inner face of the shield member being brought into contact and electrically conducting. Also, in the event that the contact unit U30 is employed for grounding, though not illustrated in the drawing, the contacting portion 7*c* and shield member 1 are electrically connected by a method such as connection by a circuit, connection by an electroconductive adhesive agent or solder, or the like.

Note that, upon the electronic component being detached from the socket for electronic components 300, the contact portion 7*d* is returned to the position in the initial state illustrated in FIG. 10B by the elastic force of the elastic portion 7*b*.

Hereinafter, advantages owing to the present embodiment being employed will be described.

The socket for electronic components 300 according to the present embodiment is configured wherein, in the event that the contact unit U30 is for grounding, the contact unit U30 includes the contact portion 7*d* having electrical conductivity to be in contact with the electrode terminal TM of an electronic component, the electroconductive portion 7*e* which electrically conducts with the contact portion 7*d*, the ground contacting portions 7*f*, the based portion 7*a* which is able to be disposed in the housing 4, and the elastic portion 7*b* formed in a leaf spring shape extending in a direction where an electronic component is to be disposed from the base portion 7*a* so as to meander with a predetermined width dimension and a predetermined pitch, the contact portion 7*d* and electroconductive portion 7*e* are formed in the vicinity of the tip of the elastic portion 7*b*, and also, the ground contacting portions 7*f* are formed in a portion meandering up to a predetermined width dimension of the elastic portion 7*b*, and in accordance with the contact portion 7*d* coming into contact with the electrode terminal TM of the electronic component, the elastic portion 7*b* is pressed against a direction where the based portion 7*a* is disposed, bent in the pressed direction, and also extends in a direction orthogonal to the pressed direction, the ground contacting portions 7*f* and shield member 1 electrically conduct, and grounding is performed.

Thus, the configuration of the contact unit U30 is facilitated by forming the contact unit U30 using the elastic member 7 alone, a component configured to perform electrical conduction agrees with a component configured to perform grounding, and a portion to perform electrical conduction and a portion to perform grounding may be brought closer, the high-frequency property may be improved. Accordingly, an advantage is yielded wherein a socket for electronic components having a simple configuration which handles high frequency may be provided.

Fourth Embodiment

Figure 11A:
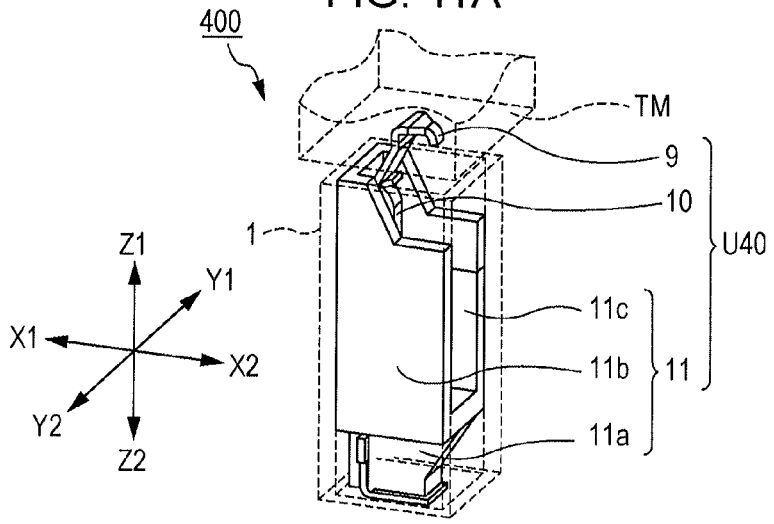
FIGS. 11A to 11C are diagrams illustrating a configuration of a socket for electronic components according to a fourth embodiment.
Figure 11B:
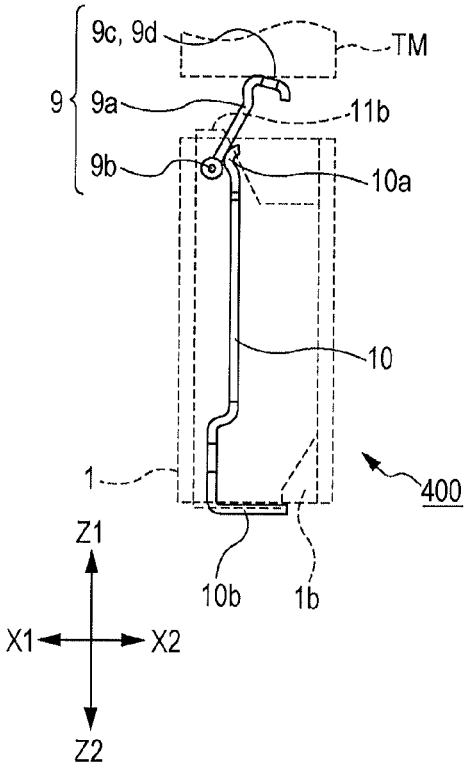
Figure 11C:
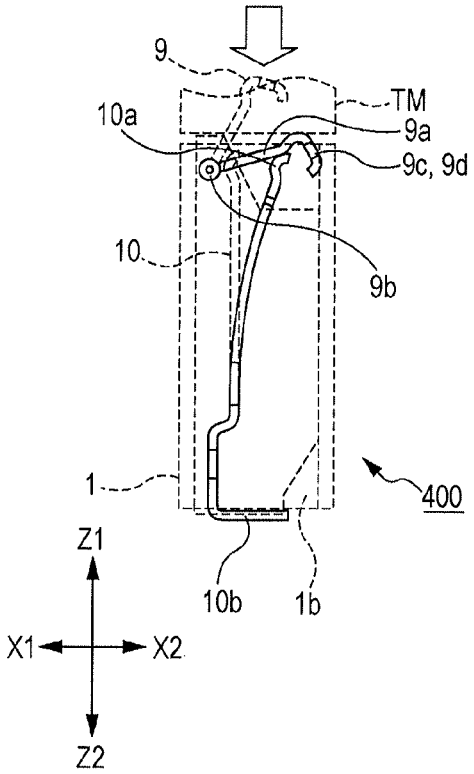

Hereinafter, a socket for electronic components 400 according to a fourth embodiment will be described with reference to FIGS. 11A to 11C. With the socket for electronic components 400, its contact unit having a configuration different from the configurations of the contact unit U10 according to the first embodiment, the contact unit U20 according to the second embodiment, and the contact unit U30 according to the third embodiment. In the following description, with regard to components common to the socket for electronic components 100 according to the first embodiment, the socket for electronic components 200 according to the second embodiment, and the socket for electronic components 300 according to the third embodiment, detailed description will be omitted, and also, with regard to component names and component reference numerals thereof, description will be made using the same as with the socket for electronic components 100 according to the first embodiment, the socket for electronic components 200 according to the second embodiment, and the socket for electronic components 300 according to the third embodiment. FIGS. 11A to 11C are diagrams illustrating the configuration of the socket for electronic components 400 according to the fourth embodiment, FIG. 11A is a perspective view illustrating the appearance of a contact unit U40, FIG. 11B is a side view illustrating the initial state of the contact unit U40, and FIG. 11C is a side view illustrating the operation state of the contact unit U40. Note that, in FIGS. 11A to 11C, in order to facilitate description, the housing 4 is not illustrated, and only the shield member 1 and contact unit U40 are illustrated.

The socket for electronic components 400 includes, as illustrated in FIGS. 11A to 11C, the shield member 1, contact unit U40, and housing 4 (see FIG. 1). The contact unit U40 is, as illustrated in FIGS. 1 and 2, configured of a moving member 9, an elastic member 10, and a holding member 11 which may hold the moving member 9 and elastic member 10.

The shield member 1 and housing 4 are common to those of the socket for electronic components 100 according to the first embodiment, socket for electronic components 200 according to the second embodiment, and accordingly, detailed description will be omitted.

The moving member 9 is, as illustrated in FIGS. 11B and 11C, made up of a metal material having electrical conductivity, and formed in a plate shape. The moving member 9 includes an electroconductive portion 9*a* formed in a plate shape, an axial portion 9*b* is formed on one edge side of the electroconductive portion 9*a*, and a contact portion 9*c* and a ground contacting portion 9*d* are formed on the other edge side of the electroconductive portion 9*a*. The axial portion 9*b* is formed in a cylindrical shape so as to roll up one edge of the electroconductive portion 9*a* in the other edge direction. The contact portion 9*c* is formed by performing bending on the other edge of the electroconductive portion 9*a* in an arc shape. Also, the contact portion 9*c* also serves as the ground contacting portion 9*d*.

The elastic member 10 is, as illustrated in FIGS. 11A to 11C, made up of a metal material having electrical conductivity, and is formed in a long plate shape. The elastic member 10 includes a pressing portion 10*a* which has been subjected to bending in an arc shape at one edge thereof, and a contacting portion 10*b* which electrically conducts with the wiring of the wiring board PB on the other edge thereof.

The holding member 11 is, as illustrated in FIG. 11A, made up of a synthetic-resin material. The holding member 11 includes a base portion 11*a* formed in a rectangular parallelepiped shape, and a housing portion 11*b* formed in a wall shape in a direction perpendicular to a certain face from three sides that make up a certain face of the base portion 11*a*. A storage portion 11*c*, which may store the moving member 9 and elastic member 10, is formed in the housing portion 11*b*.

With the moving member 9, as illustrated in FIGS. 11A to 11C, the axial portion 9*b* is held at the housing portion 11*b* of the holding member 11. At this time, the axial portion 9*b* is sandwiched by two faces which face, in the vicinity of the tip of the housing portion 11*b* on a side separated from the base portion 11*a*, and the moving member 9 is axially supported so as to turn with the axial portion 9*b* as the axis. Also, with the elastic member 10, the pressing portion 10*a* is extended within the storage portion 11*c* of the housing portion 11*b*, sandwiching the base portion 11*a* of the holding member 11, and also the contacting portion 10*b* is extended along a face on a side facing the housing portion 11*b*, of the base portion 11*a*. Also, the pressing portion 10*a* of the elastic member 10 comes into contact with the electroconductive portion 9*a* of the moving member 9, and presses the moving member 9 in a direction where the contact portion 9*c* separates from the base portion 11*a*. Also, the moving member 9 may turn against the pressing force of the elastic member 10. In this manner, the contact U40 is configured.

Also, in the diagrams illustrated in FIGS. 11A to 11C, the contact unit U40 is configured wherein one set of the moving member 9 and elastic member 10, and the housing portion 11*b* are provided to the base portion 11*a*, but with the present embodiment, as with the first embodiment, the contact unit U40 may be employed as the mode of a contact bar (not illustrated) where multiple sets of the moving member 9 and elastic member 10, and the housing portion 11*b* are provided to the base portion 11*a*.

Next, the configuration of the socket for electronic components 400 will be described with reference to FIGS. 11B and 11C. The socket for electronic components 400 has a configuration wherein the contact unit U40 is disposed in the openings 1*b* of the lattice of the shield member 1, and the shield member 1 and contact unit U40 are held in the housing 4 (see FIG. 1). With the contact units U40 stored in the openings 1*b* of the lattice of the shield member 1, the tip of the housing portion 11*b* of the holding member 11 protrudes from the upper edge portion (edge portion on Z1 side) of the shield member 1, and also, the contact portion 9*c* of the moving member 9 is disposed in a position where the contact portion 9*c* may come into contact with the shield member 1 by turning. In this manner, the socket for electronic components 400 is formed.

Also, in the event that the contact unit U40 is for grounding, grounding may be performed by the ground contacting portion 9*d* and shield member 1 being brought into contact. Note that the shield plate 1*a* in a portion corresponding to the contact unit U40 which is not for grounding has been subjected to coating or plating with insulation properties, and accordingly, grounding is not performed even when the ground contacting portion 9*d* of the contact unit U40 which is not for grounding and the shield member 1 are brought into contact.

Next, the operation of the socket for electronic components 400 will be described with reference to FIGS. 11A to 11C.

Upon an electronic component being attached to the socket for electronic components 400, first, as illustrated in FIG. 11B, the electrode terminal TM of the electronic component and the contact portion 9*c* of the moving member 9 are brought into contact, and between the electronic component and the socket for electronic components 400 electrically conducts. Thereafter, as illustrated in FIG. 11C, in accordance with the contact portion 9*c* coming into contact with the electrode terminal TM of the electronic component, upon the moving member 9 being pressed in a direction of an arrow F, the moving member 9 turns with the axial portion 9*b* as the center against the pressing force of the elastic member 7, and the contact portion 9*c* comes into contact with the shield member 1 while being bent. The contact portion 9*c* also serves as the ground contacting portion 9*d*, and accordingly, in the event that the contact unit U40 is for grounding, grounding may be performed by the contact portion 9*c* and the inner face of the shield member 1 being brought into contact and electrically conducts. Note that grounding may be performed by the contact portion 9*c* and the upper edge portion of the shield member 1 being brought into contact. Also, in the event that the contact unit U40 is employed for grounding, though not illustrated in the drawings, the contact portion 10*b* and shield member 1 are electrically connected by a method such as connection by a circuit, connection by an electroconductive adhesive agent or solder, or the like.

Note that, upon the electronic component being detached from the socket for electronic components 400, the moving member 9 is returned to the position in the initial state illustrated in FIG. 11B by the pressing force of the elastic portion 10.

Hereinafter, advantages owing to the present invention being employed will be described.

The socket for electronic components 400 according to the present embodiment is configured wherein the moving member 9 includes the axial portion 9*b* on one edge side which is axially supported so as to turn, includes the contact portion 9*c* also serving as the ground contact portion 9*d* on the other edge side, includes the electroconductive portion 9*a* between the contact portion 9*c* and the axial portion 9*b*, and the elastic member 10 comes into contact with the electroconductive portion 9*a* to press the moving member 9 in a rotational direction where the contact portion 9*c* is separated from the shield member 1, and in the event that the contact unit U10 is for grounding, the contact portion 9*c* is pressed in a direction against the pressing force of the elastic member 10 to make the moving member 9 turn, and the contact portion 9*c* electrically conducts with the shield member 1, thereby performing grounding.

Thus, the contact portion 2*b* which is a portion configured to perform electrical conduction also serves as the ground contacting portion 5*a*, thereby enabling grounding to be performed at a portion further closer to the portion to perform electrical conduction, and an advantage is yielded wherein a socket for electronic components of which the high-frequency property is further improved may be provided.

Also, the socket for electronic components 400 according to the present embodiment may be configured wherein, in the event that the contact unit U10 is for grounding, in accordance with the contact portion 9*c* coming into contact with the electrode terminal TM of the electronic component, the contact portion 9*c* is pressed in a direction against the pressing force of the elastic member 10 to make the moving member 9 turn, and the contact portion 9*c* is brought into contact with the upper edge portion of the shield member 1 and electrically conducts therewith, thereby performing grounding.

Thus, grounding is performed by the contact portion 9*c* electrically conducting with the upper edge portion of the shield member 1, thereby enabling the portion to perform electrical conduction to be further brought closer to the portion to perform grounding, and an advantage is yielded wherein the high-frequency property is further improved.

Also, the socket for electronic components 400 according to the present embodiment is configured wherein the tip portion of the housing portion lib of the holding member 11 protrudes from the upper edge portion of the shield member 1.

Thus, even in the event that an electronic component has been attached so as to be pressed against the socket for electronic components 400 with excessive force, force is not excessively propagated to the elastic member 10 by the electronic component and the tip portion of the housing portion 11*b* being brought into contact, whereby return failure or connection failure or the like due to deformation of the contact portion 9*c* may be prevented.

As described above, though the sockets for electronic components according to embodiments of the present invention have specifically been described, the present invention is not restricted to the above-mentioned embodiments, and the embodiments may be implemented by various modifications being made without departing from the essence of the present invention. For example, the embodiments may be implemented by being modified as follows, and these embodiments are also encompassed in the technical range of the present invention.

(1) With the first embodiment, though the number of protrusions provided to the contact portion 2*b* in FIG. 1 is one, there may be multiple protrusions as illustrated in FIGS. 2 and 3. Contact is further stabilized by providing the multiple protrusions, and also at the time of turning in accordance with movement of the moving member 2, the protrusions do not serve as the rotating center. Therefore, the protrusions slidably comes into contact with the electrode terminal TM of the electronic component, and accordingly, even if dust or the like adheres thereto, self-cleaning effects act such that an advantage is yielded wherein connection failure is not readily caused.

Figure 12A:
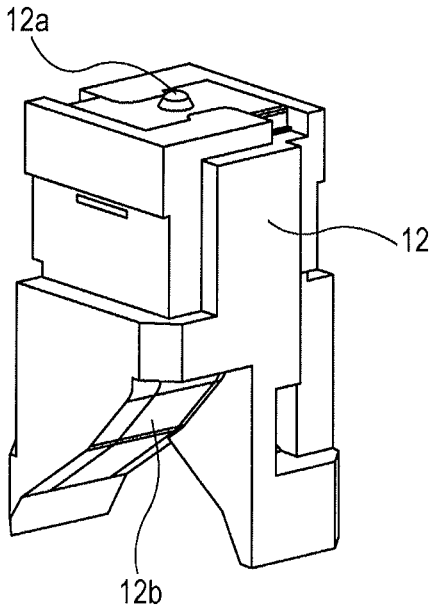
FIGS. 12A and 12B are diagrams illustrating a moving member and a ground contacting member, according to a modification.
Figure 12B:
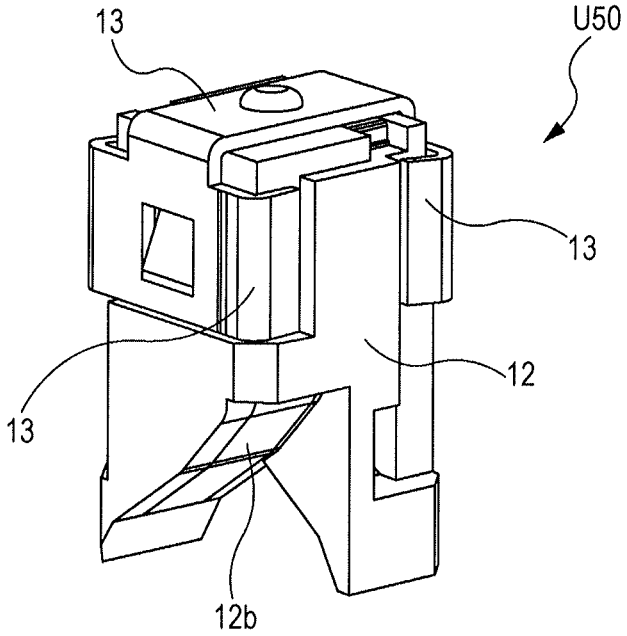
Figure 13:
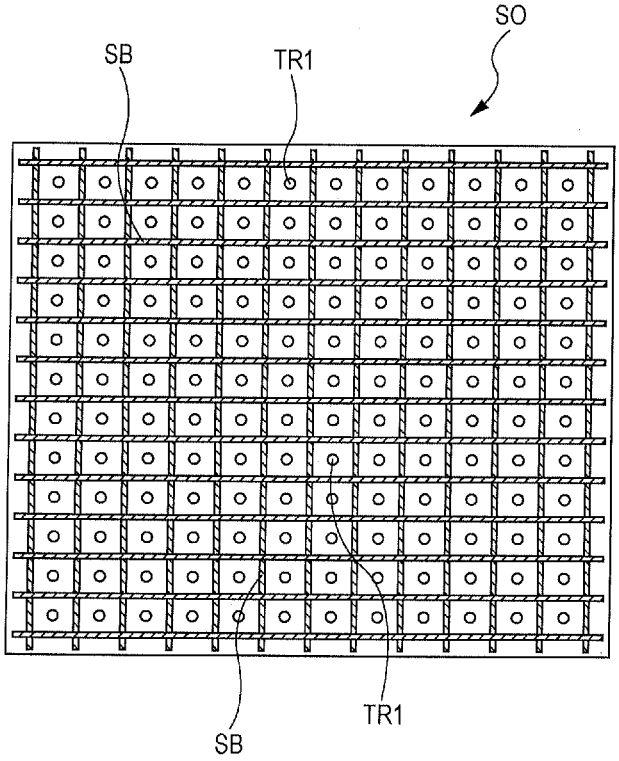
PRIOR ART FIG. 13
FIG. 13 is a diagram illustrating a socket for electronic components according to U.S. Pat. No. 6,877,223.

(2) With the first embodiment, though the ground contacting portion 2*a* is provided to the side faces of the moving member 2, in the event that the contact unit U10 is not for grounding, the ground contact portion 2*a* may be omitted. For example, as illustrated in FIGS. 12A and 12B, the configuration equivalent to the ground contacting portion 2*a* according to the first embodiment is not provided to a moving member 12, a ground contacting member 13 of another component may be employed instead. At this time, the moving member 12 is, as illustrated in FIG. 12A, configured wherein as with the moving member 2, a contact portion 12*a* is provided thereon, and an electroconductive portion 12*b* is provided on the lower face, and only in the event that a contact unit U50 using the moving member 12 is for grounding, as illustrated in FIG. 12B, the ground contacting member 13 is retained so as to cover the moving member 12 therewith, and accordingly, the ground contacting member 13 and contact portion 12*a* electrically conduct, and also, a portion of the side faces of the moving member 12 is covered with the ground contacting member 13, and the same function as with the ground contacting portion 2*a* according to the first embodiment is obtained. According to such a configuration being employed, there is no need to change coating or plating with insulation properties for the shield member 1 in the event that the contact unit U50 (only the moving member 12 and ground contacting member 13 are described) is for grounding or in the event of not for grounding, and assembly may readily be performed, and costs may be reduced. Also, with the second embodiment as well, if the same configuration is employed, the same advantage may be obtained.

(3) With the first embodiment, though the ground contacting portion 5*a* is formed protruding in two directions that laterally face from the upper face (face on Z1 side) of the pedestal portion 5*f*, the directions are not restricted to the two directions that face, and for example, the ground contacting portion 5*a* may be formed protruding in four directions.

What is claimed is:

1. A socket for an electronic component configured to connect each electrode terminal of the electronic component to a wiring of a wiring board comprising:

a shield member having electrical conductivity and including a plurality of openings disposed in a housing to be mounted on the wiring board;

a contact unit for signals configured to electrically conduct between an electrode terminal of the electronic component and a wiring of the wiring board, and a contact unit for grounding, the contact unit for grounding comprising: a moving member, and an elastic member; wherein the moving member includes a contact portion having electrical conductivity configured to be in contact with the electrode terminal of the electronic component, and an electroconductive portion configured to electrically conduct with the contact portion, and wherein the elastic member electrically conducts the wiring of the wiring board, and also electrically conducts the electroconductive portion of the moving member, and presses the moving member against the direction of movement of the moving member;

wherein the contact unit for grounding is disposed in an opening; and wherein the contact unit for grounding has a ground contacting portion, and the contact unit for grounding is configured such that when the contact unit moves, the ground contacting portion and the shield member are in electrically conducting contact such that grounding is performed.

2. The socket for the electronic component according to claim 1, wherein the moving member has the ground contacting portion at a side face facing an inner face of the opening of the shield member.

3. The socket for the electronic component according to claim 2, wherein the elastic member has:

a base portion configured to be able to be disposed in the housing, and a first elastic portion and a second elastic portion formed in a leaf spring shape extending in a moving direction of the moving member from the base portion;

and wherein the moving member has the contact portion on the upper surface with which the electrode terminal of the electronic component may be in contact, has the ground contacting portion on the side face, and has the electroconductive portion on the bottom face, and the contact portion, the electroconductive portion, and the ground contacting portion mutually electrically conduct;

and wherein the electroconductive portion includes a first inclined face portion where a face inclined to one side as to the moving direction of the moving member is formed, and a second inclined face portion where a face inclined to the other side as to the moving direction of the moving member is formed;

and wherein the moving member is disposed on the elastic member in a state in which the first inclined face portion and the first elastic portion are brought into contact, and also, the second inclined face portion and the second elastic portion are brought into contact;

and wherein, in accordance with the moving member moving, the moving member turns on an axis parallel to the moving direction of the moving member as the center due to elastic force of the elastic member, and the ground contacting portion and the shield member electrically conduct, and grounding is performed.

4. The socket for the electronic component according to claim 3, wherein the root of the first elastic portion is disposed on one of two virtual parallel lines on the upper surface of the base portion, and the root of the second elastic portion is disposed on the other of the two virtual parallel lines on the upper surface of the base portion, and also, the first elastic portion and the second elastic portion are disposed in different positions along the extending directions of the two virtual parallel lines.

5. The socket for the electronic component according to claim 1, wherein the shield member is configured of a plurality of shield plates made up of a metal plate piece being combined in lattice form.

6. The socket for the electronic component according to claim 5, wherein the moving member is formed in a generally rectangular shape, has the contact portion on the upper face, has the ground contacting portion formed on at least side faces which face to each other so as to protrude outward, has the electroconductive portion on the bottom face, and the contact portion, the electroconductive portion, and the ground contacting portion mutually electrically conduct;

and wherein distance dimension between the tips of the ground contacting portion is longer than interval dimension between the shield plates;

and wherein, in accordance with movement of the moving member, grounding is performed by the ground contacting portion and the upper edge portion of the shield member being brought into contact and electrically conducting.

7. The socket for the electronic component according to claim 1, wherein the moving member includes:

an axial portion on one edge side configured to be axially supported so as to turn, the contact portion on the other edge side also serving as the ground contacting portion, and the electroconductive portion between the contact portion and the axial portion;

and wherein the elastic member is in contact with the electroconductive portion, and presses the moving member in a rotational direction where the contact portion is separated from the shield member;

and wherein, in accordance with the contact portion coming into contact with the electrode terminal of the electronic component, grounding is performed by pressing the contact portion in a direction against pressing force of the elastic member to make the moving member to turn, and to make the contact portion to electrically conduct with the shield member.

8. The socket for the electronic component according to claim 7, wherein, grounding is performed by pressing the contact portion in a direction against pressing force of the elastic member to make the moving member to turn, and to make the contact portion to come into contact with the upper edge portion of the shield member so as to electrically conduct.

9. The socket for the electronic component according to claim 2, wherein the elastic member is ground-connected to the shield member on a side closer to the wiring board than the ground contacting portion of the moving member.

10. A socket for an electronic component configured to connect each electrode terminal of the electronic component to a wiring of a wiring board comprising:

a shield member having electrical conductivity and including a plurality of openings disposed in a housing to be mounted on the wiring board;

a contact unit for signals configured to electrically conduct between an electrode terminal of the electronic component and a wiring of the wiring board, and a contact unit for grounding disposed in an opening;

wherein the contact unit for grounding includes a ground contacting portion, a contact portion having electrical conductivity configured to be in contact with the electrode terminal of the electronic component, an electroconductive portion electrically conducting with the contact portion, the ground contacting portion, a base portion configured to be able to be disposed in the housing, and an elastic portion formed in a leaf spring shape extending in a direction where the electronic component is disposed from the base portion so as to meander with a predetermined width dimension and a predetermined pitch, wherein the contact portion and the electroconductive portion are formed near the tip portion of the elastic portion, and the ground contacting portion is formed in a location meandering up to a predetermined width dimension of the elastic portion; and the contact unit for grounding is configured such that when the contact unit moves, the contact portion comes into contact with the electro terminal of the electronic component, the elastic portion is pressed against a direction where the base portion is disposed, bends in the pressed direction, and extends in a direction orthogonal to the pressed direction, and the ground contacting portion and the shield member electrically conduct, such that grounding is performed.

* * * * *